United States Patent [19]

DeWeert et al.

[11] Patent Number: 4,875,303

[45] Date of Patent: Oct. 24, 1989

[54] MUZZLELOADING POWDER AND PROJECTILE TOOL

[76] Inventors: William R. DeWeert, 1560 Dammeron Valley Dr., E.; Frank Manning, 2153 Dammeron Valley Dr., E., both of Dammeron Valley, Utah 84783

[21] Appl. No.: 173,549

[22] Filed: Mar. 25, 1988

[51] Int. Cl.[4] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 163,404 | 6/1875 | Phillips | 42/90 |
| 2,451,015 | 9/1944 | Adams | 206/47 |
| 3,747,252 | 11/1973 | Walker | 42/90 |
| 4,050,175 | 1/1977 | Mulinix | 42/90 |
| 4,112,606 | 4/1978 | Griffin | 42/90 |
| 4,135,322 | 1/1979 | Tice et al. | 42/90 |
| 4,152,858 | 2/1979 | Dobbs | 42/90 |
| 4,207,698 | 6/1980 | Burson | 42/90 |
| 4,229,897 | 7/1980 | Snowden | 42/90 |
| 4,373,285 | 5/1983 | Grout et al. | 42/90 |
| 4,411,088 | 6/1983 | Wilson | 42/90 |
| 4,466,209 | 8/1984 | Strickland et al. | 42/90 |
| 4,536,983 | 3/1985 | Fry | 42/90 |
| 4,550,517 | 11/1985 | Mansfield | 42/90 |
| 4,601,125 | 7/1986 | Curtis | 42/90 |

OTHER PUBLICATIONS

Gander Mountain Inc., Reloading Catalog 88H, p. 15, Items K and L.

*Primary Examiner*—Charles T. Jordan

[57] ABSTRACT

An improved muzzleloading firearm tool 65 which facilitates the accelerated reloading of muzzleloading firearms. Such tool comprises of a body 10, for the containment of any type of muzzleloading projectile and powder and a plunger assembly which has incremental graduation marks 48 to facilitate the accelerated reloading of the tool 65 itself and when such plunger 22 is depressed it injects charge and projectile into the bore of the firearm. The tool 65 will facilitate the loading of pistols and rifles, is water resistant, and has a bore alignment feature. The tool 65 is attached directly to the firearm rendering the tool 65 in a static state of accessibility and readiness, and lends equilibrium to the firearm while aiming.

10 Claims, 4 Drawing Sheets

MUZZLELOADING POWDER AND PROJECTILE TOOL

BACKGROUND—FIELD OF INVENTION

This invention relates to muzzleloading firearms, specifically to an improved method of placing a powder charge and projectile into the bore of a muzzleloading firearm.

BACKGROUND—DESCRIPTION OF PRIOR ART

Heretofore several devices have been proposed to facilitate the accelerated loading (of charge and projectile) of muzzleloading firearms, as can be seen by reference to U.S. Pat. Nos. 4,050,175; 4,152,858; 4,536,983; and 4,373,285.

The device in U.S. Pat. No. 4,050,175 employs accelerated loading principles and is designed to be worn around the neck and upon deployment requires the user to pull such device in a vertical motion disengaging unit from an end cap, which is contained by a lanyard, the lanyard being fixed around the users neck. This device then deploys a cutting stroke into the broach of the firearm in a similar manner that is found in most accelerated loading devices.

Users regard the method used in carrying this device awkward due to the lack of static stability that device carried in this manner produces, inasmuch as the device itself swings unrestrained.

The aforementioned device lacks a feature which provides for the accelerated reloading of the device itself. Such device is constrained to the loading of patch and ball projectiles and lacks a means to facilitate alignment with the bore of a firearm. This device can also become inadvertently detached from its containing end cap and is limited to the loading of rifles.

Other devices such as those found in U.S. Pat. Nos. 4,152,858; 4,536,983; and 4,373,285, while being similar with U.S. Pat. No. 4,050,175 with regard to the depression of charge and projectile into the bore of a firearm, facilitates the use of the frangible membrane to contain charge and projectile in these devices.

Users acknowledge that while these devices are effective in relation to their quick loading capabilities, reloading of these devices involve fragile and penetrable components and are not recognized as being efficient in the timely reloading of such devices themselves.

Users are wary about the aforementioned frangible membrane material being injected into the bore of a firearm and the possibility of adhesion of this material to the bore under the application of heat, such as when the firearm is discharged.

Users would therefore, find it desirable to have a device which is more static in relation to the containment of the device prior to deployment, and furthermore, to have a device which comprises fewer components; to have a device which employs less fragile components; and to have a device which facilitates the accelerated reloading capability of the device itself.

OBJECTS AND ADVANTAGES

Accordingly we claim the following as the objects and advantages of this invention: to provide a tool for the accelerated placing of powder and projectile into the barrel (bore) of a muzzleloading firearm, to provide a tool that is attached to the firearm so that in addition to becoming an integral part of the firearm the tool lends additional weight to the firearm, thus added stability while aiming.

In addition we claim the following additional objects and advantages: to provide a measuring capability so that the proper amount of powder can be placed into the tool to facilitate the accelerated reloading of the tool itself, to provide the economy of motion not present in accelerated loading devices to date, and to eliminate the awkwardness associated with other devices, to provide a tool which functions as a complete unit and which is not reliant on other devices to assert its usefulness, to provide for the incorporation of more than one device onto the firearm, to provide an alignment feature for facilitating alignment with the bore of the firearm, to provide a device which will facilitate the loading of patch and ball, conical projectiles, and accelerator type projectile containers or any other projectile embodiment, to provide a device which is water resistant, to provide a device which will project charge and projectile into muzzleloading pistols as well as muzzleloading rifles, to provide an economy of motion with respect to the static state of accessibility in the development of the tool itself, to provide a tool with the least number of parts, and to provide for the most efficient state of operability and orderliness possible.

Readers will observe further objects and advantages of the invention from consideration of the ensuing description and the accompanying drawings.

DRAWING FIGURES

DRAWING REFERENCE NUMERALS

Figure 1:
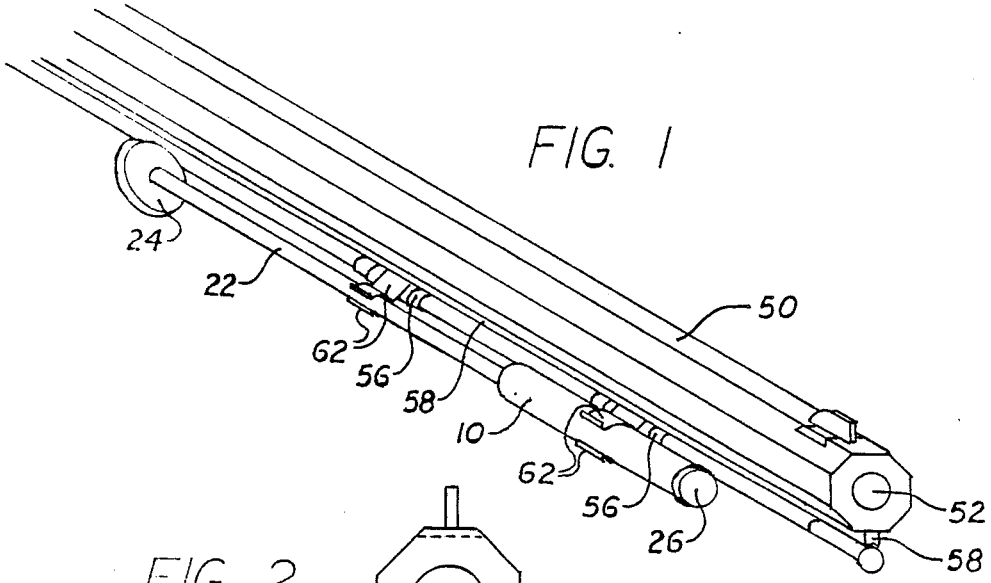
FIG. 1 shows a perspective view of the invention in a loaded position attached to the firearm.

10 body
12 bushing seat in 10
14 bushing
16 retaining clip groove in 14
18 hole in 14
20 plunger flared end
21 plunger end core
22 plunger shaft
23 concave depression in 20
24 handle
25 hole in 24
26 end cap
28 retaining clip slot in 10
30 retaining clip for 14
32 alignment bevel in 10
34 plunger core
36 inner sleeve
38 bonding of 24 to 22
40 conical projectile
42 round ball
44 patch
48 powder graduation (10 gr.) marks
50 firearm barrel
52 firearm bore
56 thimble(s)
58 rib
62 attachment bracket(s)
64 interior annular groove
65 tool of the invention

MULTIPLE-PIECE TOOL—DESCRIPTION

Figure 7:
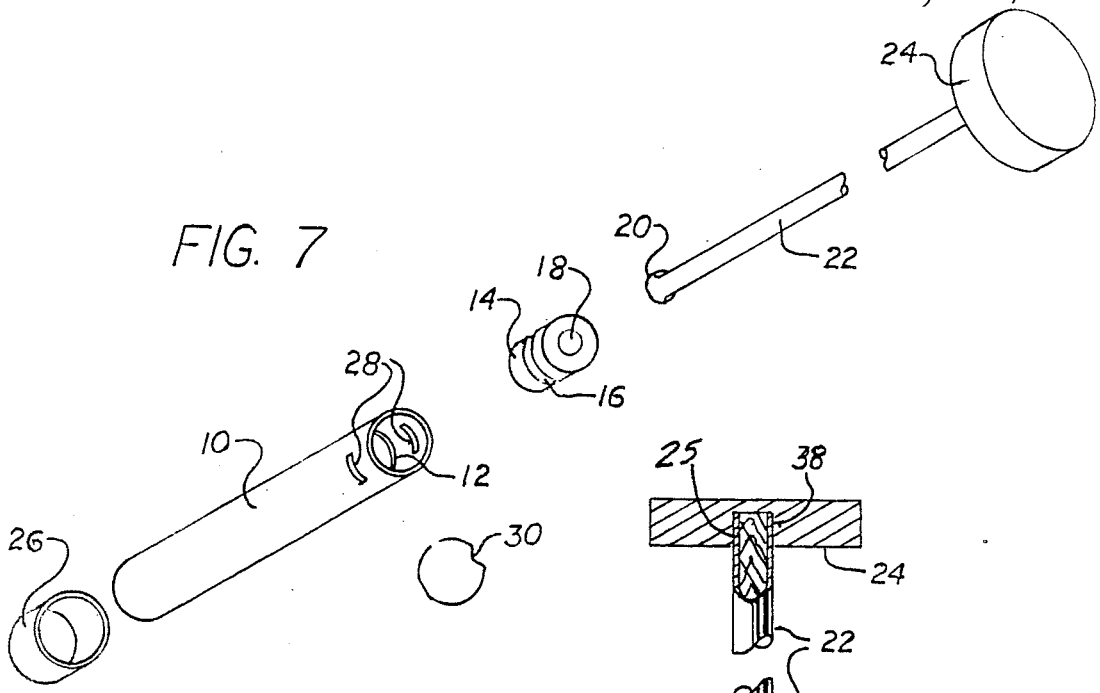
FIG. 7 shows an exploded perspective view of the invention.

FIG. 1 and FIG. 7 show the object of the invention according to the preferred embodiment of the multiple-piece tool, but is best shown in FIG. 7 and will be henceforth referred to as 65.

Figure 9:
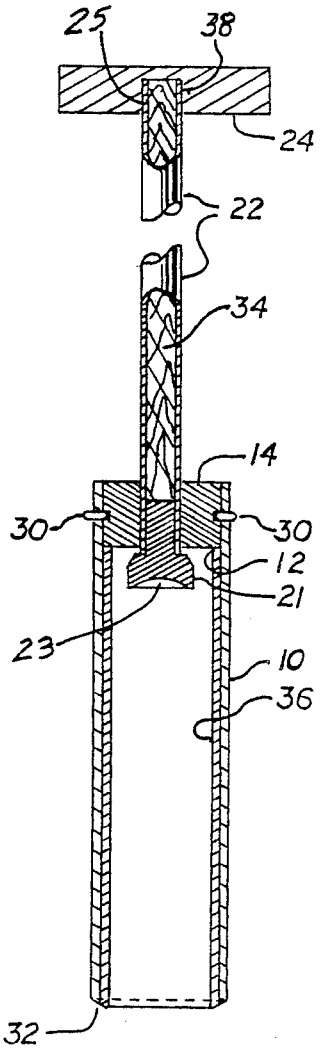
FIG. 9 shows a variation of a side sectional view of the invention with a laminated body and laminated plunger assembly and an insertable plunger flared end.

The tool 65 of the invention in its preferred embodiment is composed primarily of brass and is comprised of an enlarged oval shaped handle 24 which is bonded 38 (as best shown in FIG. 9) to the plunger shaft 22 by inserting plunger shaft 22 into a hole 25 in handle 24. The hole 25 being slightly larger than the plunger shaft's diameter, such bonding being facilitated by the application of a vinculum means to the handle 24, hole 25 and the plunger shaft 22 at their respective point of connection.

The plunger shaft 22 (as viewed best in FIG. 7) being cylindrical and elongated longitudinally, is inserted into the hole 18 of the bushing 14 such hole 18 being of sufficient diameter to allow the plunger shaft 22 to move slideably through the bushing 14 the full length of the plunger shaft 22. The plunger shaft 22 having incremental reference numbers along its longitudinal length (as viewed in FIG. 5). Those marks 48 being powder graduation references. The plunger flared end 20 is located on the plunger shaft 22 at the diametrically opposing end of the plunger shaft 22 from which the handle 24 is located and is sufficient size to retain the bushing 14 slidingly on the plunger shaft 22 and is of sufficient size to permit a concave depression 23 (as best viewed in FIG. 5) to encompass a portion of the parabolic vertical most part of the projectiles circumference.

The body 10 is cylindrical and tubular in configuration and is of a sufficient inside diameter to permit the bushing 14 to be freely and slideably inserted into the body 10 and be seated onto the bushing seat 12 which is made up of an inner sleeve 36 and is cylindrical and tubular in configuration and is of sufficient length and diameter to telescopically be inserted into body 10 (best viewed on FIG. 9) and is no longer in length than the body 10 and acts to limit the depth of which the bushing 14 can be inserted. The body 10 is of sufficient length to accomodate a projectile and maximum charge of powder.

The bushing 14 is contained frictionally within the body 10 by means of a retaining clip 30 and is applied to the bushing 14 by means of a retaining clip groove 16 located in the bushing 14 which is an annular groove located circumferentially around said bushing 14.

The bushing retaining clip 30 is attached and held in place on the body 10 by means of two bushing retaining clip slots 28 which are located so as to align with the bushing retaining clip groove 16, which is annular in configuration.

The body 10 end cap 26 is of sufficient inside diameter so as to remain frictionally attached to the body 10 and is constructed so as to prohibit the loaded contents of the tool 65 to escape.

MULTIPLE-PIECE TOOL—OPERATION

The multiple-piece tool of FIG. 1 serves a wide variety of muzzleloading firearm needs, and performs several important functions. The following is an expanding explanation of the aforementioned functions and needs.

Loading the Tool of the Invention

Figure 4:
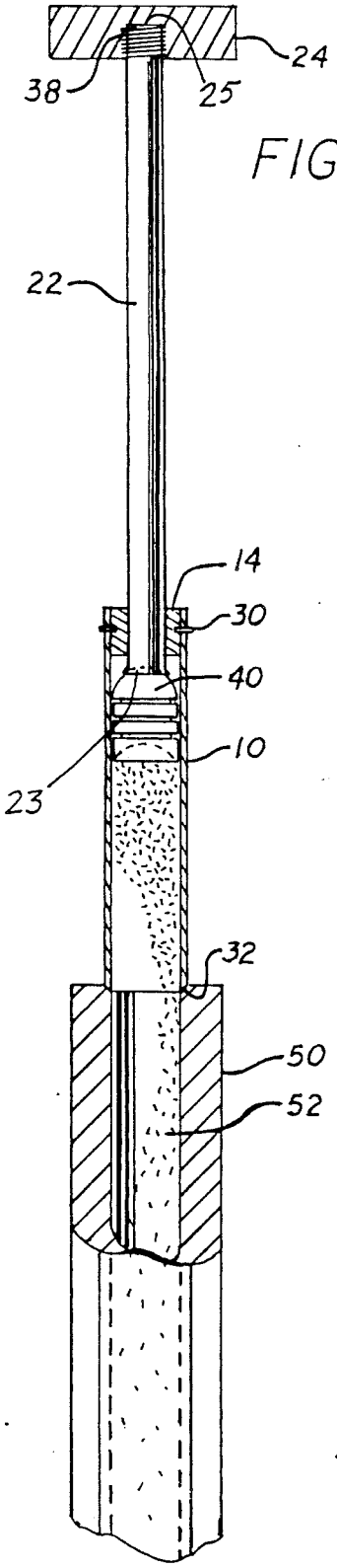
FIG. 4 shows a side sectional view of the invention aligned with the bore of the firearm with a conical projectile and powder at the moment of alignment and in a ready position for the plunger to be depressed.
Figure 5:
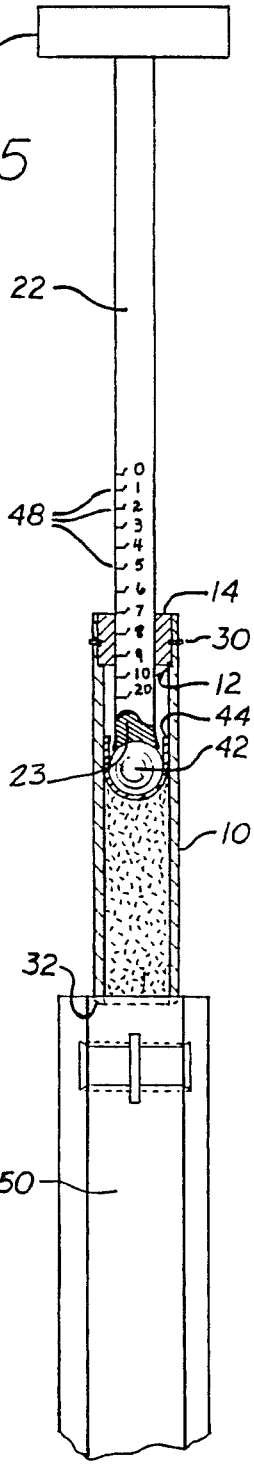
FIG. 5 shows a side sectional view of the invention with a patch and ball and powder in place in the invention, and with the plunger shaft incremented for reference to measured volumes of powder.

To prepare the tool 65 with a charge and projectile, the tool 65 as viewed in FIG. 4 is separated by pulling the plunger 22 and the body 10 apart in axial opposing directions and the end cap 26 is removed. After separating the body 10 and the plunger assembly, a projectile 40, in FIG. 4, or patch 44 and ball 42, as viewed in FIG. 5, is inserted into the bushing 14 end of the tool 65.

The plunger 22 is then used to depress the projectile into the body 10 far enough to allow the bushing 14 to be snapped back into the body 10 and be retained by the bushing retaining clip 30.

The user then holding the tool 65 vertically with the handle 24 in the downward position, then pours a predetermined amount of powder into the end cap 26 end of the body 10. The user then pushes the plunger shaft 22 further into the body 10 until the powder is flush or even with the end cap 26 end of the body 10, and making note as to the reading of the powder graduation mark 48 (as viewed in FIG. 5) on the plunger shaft 22 that is in alignment with the bushing 14 or its relative position thereto.

The user then places the end cap 26 onto the end cap 26 end of the body 10 and tool 65 is loaded and ready for application to the firearm.

Once the tool 65 has been loaded with a particular projectile and a predetermined amount of powder, using the method described above, the user then, after having inserted the same type of projectile into body 10 and replacing plunger shaft 22 and bushing 14, need only to depress plunger shaft 22 to the noted powder graduation mark 48 and fill the end cap 26 end of the body 10 to the aforementioned flush or level state and replace the end cap 26 and once again the tool 65 is loaded.

Attachment to the Firearm

Figure 2:
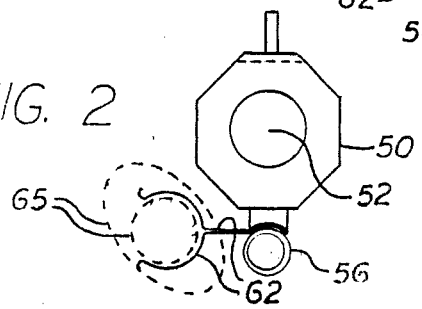
FIG. 2 shows a front elevational view of the barrel and bore of a typical muzzleloading rifle in relation to the location and conformation of the attachment brackets which retain and hold the tool of the invention.

After having described the method of loading the tool 65 of the invention, the tool 65 is attached to the attachment brackets 62 of FIG. 2, the dash lines showing the relative position of the tool 65 in relation to the barrel of the firearm and being contained in the attachment brackets 62, which are generally attached between the thimble 56 and rib 58 on the firearm barrel 50. FIG. 1 showing the tool 65 in perspective view mounted on firearm. The tool 65, thus becomes an integral part of the firearm. Furthermore the tool 65 is in a readied and static state of accessibility for removal and deployment of charge and projectile into the bore of the firearm.

Charging Firearm

With the tool 65 charged and attached to the firearm, the firearm is charged with the powder and projectile using the tool 65 as follows.

The firearm is rested on the ground with the bore 52 of the firearm in an upward or vertical position. The firearm is grasped with one hand at the end of the barrel 50 with the thumb and at least the first finger in an upward position and clear of the end of the muzzle and in the relative area of the bore 52. The tool 65 of the invention is then removed from the attachment brackets 62 of FIG. 1, with the tool 65 being grasped with the thumb and first finger of the other hand resting on the end cap 26, the rest of the same hand grasping the body 10, at which point the tool 65 is removed by pulling in a motion away from the attachment brackets 62 as noted by the arrow of FIG. 2. The thumb and first finger remove the end cap 26 from the end cap 26 end of the body 10 and the tool 65 is guided to and aligned with the bore 52 and then inverted to a position as shows best in FIG. 4.

Figure 6:
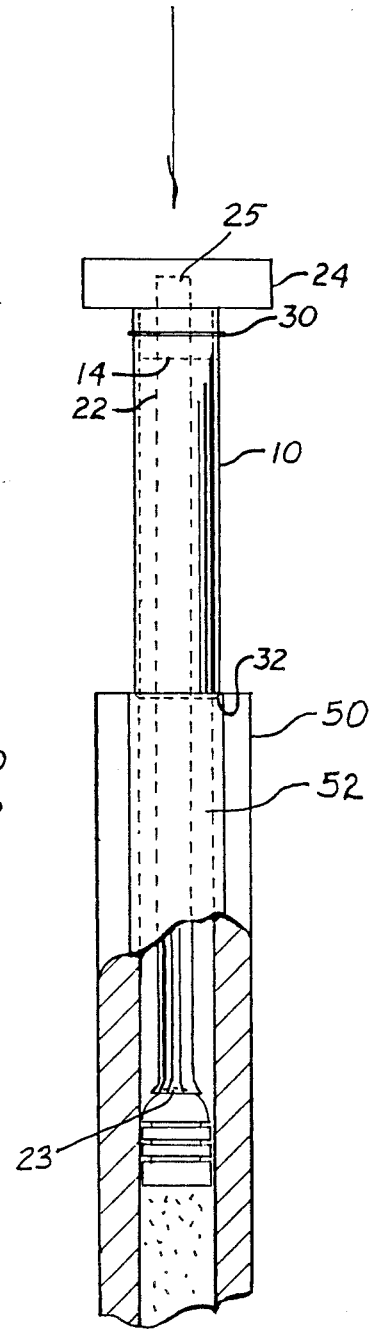
FIG. 6 shows a side elevational view of the invention after the plunger assembly has been completely depressed, and the relative location of the conical projectile in the bore of the firearm of FIG. 4 at the completion of the depression of the plunger.

Then, as viewed in FIG. 6, the handle 24 is depressed to its downward most position, injecting the projectile into the bore 52. The powder generally having fallen into the bore 52 by gravitational means.

Reattachment to Firearm

Figure 3:
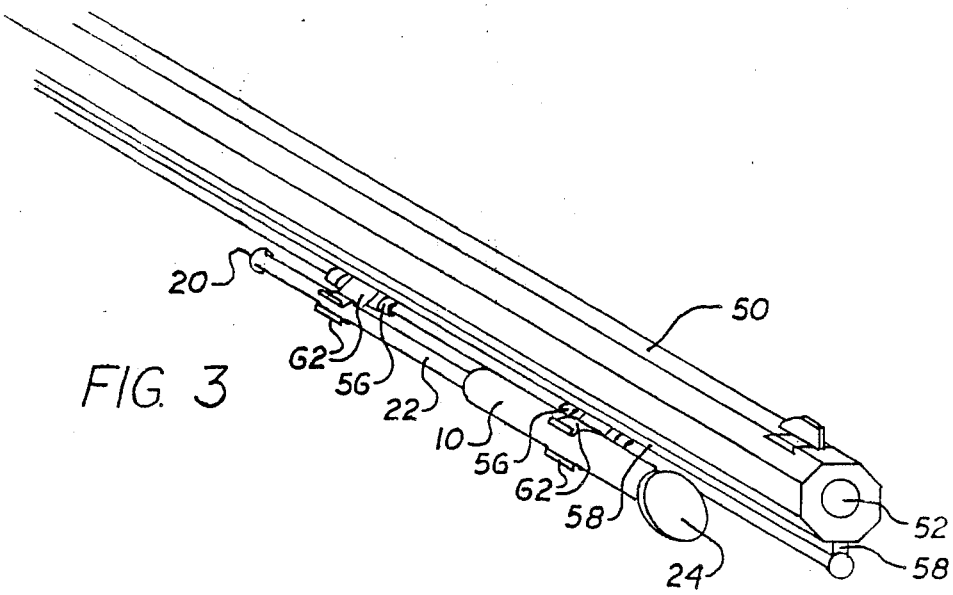
FIG. 3 shows a perspective view of the invention in a position such as would be used after the completion of the loading of the firearm and upon reattachment of the invention to the attachment brackets of FIG. 2.

Having placed powder and projectile into the firearm in the aforementioned manner, the tool 65 of the invention is then withdrawn vertically from the bore 52 of the firearm and in its compressed state is reattached to the attachment brackets 62, the tool 65 still being in its compressed vertical state as shown in FIG. 3.

After having described the basic operational elements of the tool 65 above in some detail, the actual loading of the tool 65 is accomplished in usually less than twelve seconds. Furthermore, the time that is required to (having just discharged the firearm) reload the firearm, already having a loaded tool 65 in position on the Firearm (as in FIG. 1), in the manner previously described, is generally under 15 seconds. Within the above mentioned parameter, a control is facilitated requiring an individual to accomplish the operation without aid and within that parameter is required to place a second shot within 4 inches of a point of impact at 25 yards to stop time, i.e. first shot starts time period and reloaded shot stops clock equals time with a 5 shot average.

The following are further operational disclosures of the tool 65 of the invention:

Reloading Pistols—The tool 65 of the invention, while not adapted for attachment to pistols, is equally efficient at reloading pistols using the same method as described in "charging firearms" above.

Figure 8:
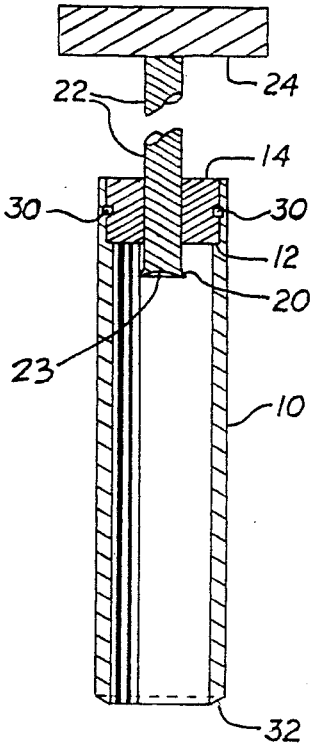
FIG. 8 shows a variation of a side sectional view to represent a solid piece body and an annular groove on the inside body of the invention.

Alignment Capability—The tool 65 of the invention has an alignment bevel 32 which is a design feature that can be viewed best in either FIG. 4 or FIG. 5, but is also present in FIG. 6, FIG. 8 and FIG. 9. Upon vertical visual alignment of the tool with the bore of the firearm 52, the alignment bevel 32 maintains the position through graduational pressure at the point of contact between the tool 65 and the bore 52.

Water Resistance—The tool 65 of the invention is water resistant in that the end cap 26 through use and exposure to the different lubricants which are prevalent and necessary to facilitate the essential sealing between projectile 40 and bore 52, creates a natural sealing point at the point of contact where end cap 26 and body 10 are frictionally engaged through use. This point of sealing can be accelerated initially by the application of the aforementioned lubricating means directly to the end cap 26. The application of such lubricating means has posed no predisposition to the end cap 26 losing its gripping qualities.

The water resistant quality obtained at the bushing 14 end of the body 10 is facilitated by the bushing 14 and plunger shaft 22 being directly in contact with the aforementioned lubricating means, the water resistant seal being accomplished at the different points of contact that said elements have in common.

Stabilization of Firearm—Muzzleloading rifles are basically heavier than their modern firearm counterparts, and some of the newer muzzleloading rifles have somewhat shorter barrels, making them relatively lighter than their counterparts. The addition of weight to these rifles leads equilibrium to them. Even the heavier muzzleloading rifles with the longer barrels gain some benefit from the addition of a small amount of weight.

Figure 10:
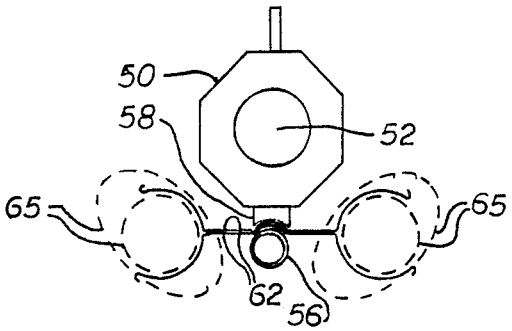
FIG. 10 shows a variation of a front elevational view of the barrel and bore of a muzzleloading rifle in relation to the location and conformation of the attachment brackets which can facilitate two tools of the invention to be attached to the firearm.
Figure 11:
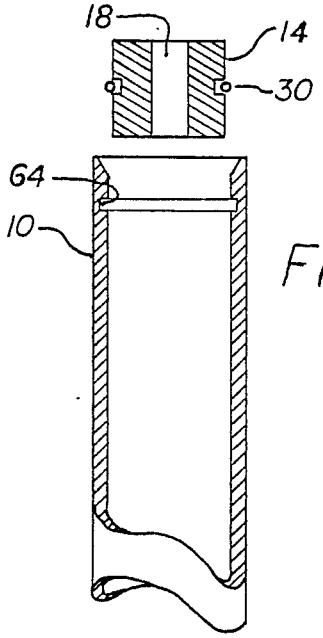
FIG. 11 shows a side sectional view of a variation of the bushing and the method of attaching the bushing to the body of the invention.
Figure 12:
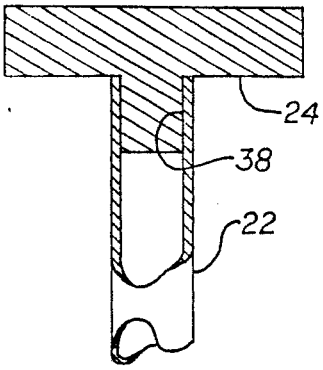
FIG. 12 shows a side sectional view of a handle which is insertable into the plunger tubular member.
Figure 13:
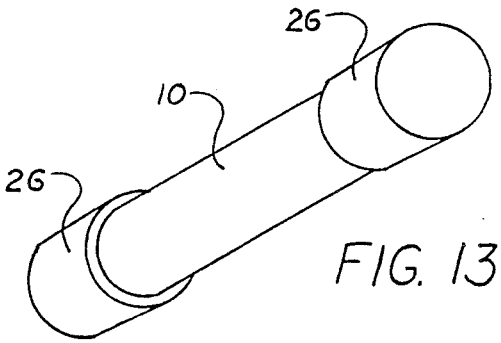
FIG. 13 shows a perspective view of a variation of end caps that can be employed on the body of the invention.

While the above description contains may specificities, these should not be construed as limitations on the scope of the invention, but rather as an exemplification of one preferred embodiment thereof. For example, the plunger shaft 22 of FIG. 7 can be constructed of any rigid material, i.e. wood, aluminum, steel, brass, copper, etc. Likewise, any other component of the invention could be made in a similar manner. The bushing 14, as another example, can be contained within the body 10 in several equally adequate ways. The bushing 14 can receive the retaining clip 30 directly into the bushing retaining clip groove 16 and can be received by the body 10, which would contain an annular groove 64 to receive the bushing 14, as can be viewed in FIG. 8, but can best be viewed in FIG. 11; or the bushing retaining clip 30 can be contained within the body 10 by an interior annular groove 64 which will contain the bushing 14 in the same manner. Further examples provide for the application of two tools 65 to be attached to the firearm as shown in FIG. 10; the handle 24 can be inserted into the plunger shaft 22 as shown in FIG. 12; the contents of the body 10 could be contained by end caps 26 as viewed in FIG. 13 so that one plunger shaft 22 assembly could be used on the individual pre-loaded mechanically compatible bodies 10; or the plunger shaft 22, instead of being flared 20 could have an insertable end core 21 as viewed in FIG. 9. Accordingly, the reader is requested to determine the scope of the invention by the appended claims and their legal equivalents, and not by the examples which have been given.

We claim:

1. A firearm attachable, muzzleloading reloading tool comprising:

an end cap for closing an end of a body, said end cap being attached frictionally upon said body which is cylindrically tubular and axially elongated and is of sufficient size circumferentially and of such axial length so as to provide for the containment telescopically within of an inner sleeve which is a cylindrical tubular member that contains a powder projectile propellant and a type of projectile;

a cylindrical bushing of such diameter so as to be slideably inserted into an end of said body, such cylindrical bushing being longitudinally sufficient in length as to provide for an annular groove circumferentially located on said bushing;

said bushing containing a cylindrical hole longitudinally axial in said bushing located at a median on the diametral axial ends of said bushing;

said bushing being contained frictionally within said body by a compressive tension retaining clip, which is compressively contained on said body, said compressive tension retaining clip being accessed to said bushing through a retaining clip slot aperture;

a plunger shaft being cylindrical and axially longitudinal, the end of said plunger shaft contained within said body is flared, the flare being of sufficient size to prohibit retraction of said plunger shaft axially through said hole in said bushing; and said plunger shaft insertingly attached to a hole in a handle at the diametrically opposite end of said flare, said attachment facilitated by a vinculum bonding.

2. The tool of claim 1 whereby said tool is attached to a firearm by one or more compressive tension attachment bracket(s), said attachment bracket(s) being integrally attached to said firearm, whereby said tool is fictionally attached to said firearm by the compressive tension of said attachment bracket(s).

3. The tool of claim 1 wherein said body and said body inner sleeve are aligned so as to stop said bushing at a point within said body.

4. The tool of claim 1 wherein said plunger shaft contains incremental powder reference marks embellished onto said plunger shaft.

5. The tool of claim 1 whereby said retaining clip is compressively contained on said body; and said retaining clip being accessed to said bushing through a retaining clip slot aperture.

6. The tool of claim 1 wherein said plunger shaft is tubular, said tubular plunger shaft receiving internally at least one material substance within the interior of said tubular plunger shaft.

7. The tool of claim 11 wherein said plunger shaft is composed of a single rigid material substance.

8. The tool of claim 1 whereby the bushing is contained within the body by a compressive tension retaining clip contained within an annular groove located on the interior portion of said body, whereby said retaining clip receives an annular groove located on said bushing circumferentially.

9. The tool of claim 1 whereby the bushing is contained within the body by the attachment of an expanding tension retaining clip into an annular groove located circumferentially on said bushing, which is inserted slidingly into the body which contains an interior beveled rim to facilitate compression of said retaining clip, said body containing an annular groove located within said body receiving said expanding tension retaining clip.

10. The construction of the tool wherein the tubular plunger shaft receives a handle containing a cylindrical protrusion located axially on one end of said handle, said cylindrical protrusion received on the internal portion of said tubular plunger shaft.

* * * * *